US005297642A

United States Patent [19]

Rajakallio et al.

[11] Patent Number: 5,297,642

[45] Date of Patent: Mar. 29, 1994

[54] APPARATUS FOR STORING DRILL RODS

[75] Inventors: Pauli Rajakallio, Siivikkala; Jouko Kaakkurivaara, Vuorentausta; Leo Häkkinen, Tampere; Pekka Koskelo, Ylöjärvi; Markku Launiemi, Tampere, all of Finland

[73] Assignee: Tamrock Oy, Tampere, Finland

[21] Appl. No.: 958,102

[22] PCT Filed: Jun. 11, 1991

[86] PCT No.: PCT/FI91/00185

§ 371 Date: Dec. 22, 1992

§ 102(e) Date: Dec. 22, 1992

[87] PCT Pub. No.: WO91/19880

PCT Pub. Date: Dec. 26, 1991

[30] Foreign Application Priority Data

Jun. 15, 1990 [FI] Finland ..... 903025

[51] Int. Cl.[5] ..... F21B 19/14

[52] U.S. Cl. ..... 175/85; 166/77.5; 175/52; 414/22.66

[58] Field of Search ..... 175/52, 85, 220; 166/77.5, 85; 414/22.66, 22.68, 22.71

[56] References Cited

U.S. PATENT DOCUMENTS 4,892,160 1/1990 Schivley, Jr. et al. ..... 175/85

FOREIGN PATENT DOCUMENTS 374408 3/1975 Sweden .

1370225 1/1988 U.S.S.R. .

84/01599 4/1984 World Int. Prop. O. .

9208873 5/1992 World Int. Prop. O. ..... 175/52

*Primary Examiner*—David J. Bagnell

*Attorney, Agent, or Firm*—Nixon & Vanderhye

[57] ABSTRACT

An apparatus for storing drill rods, comprising two drill rod cartridges each comprising a rotating rotor provided with finger boards, guides for guiding the drill rods into gaps formed by the finger boards circumferentially around the axis of the rotor. The rotors are arranged to rotate in opposite directions in such a way that projections in the finger boards of one rotor are positioned in alignment with gaps in the other rotor, the drill rods being positioned therebetween and then passed alternately with the rotor of the two cartridges along spirals to a circumference about the rotors.

7 Claims, 2 Drawing Sheets

APPARATUS FOR STORING DRILL RODS

The invention relates to an apparatus for storing drill rods, comprising two drill rod cartridges each comprising a rotating rotor provided with finger boards, means for guiding the drill rods into gaps formed by the finger boards circumferentially around the axis of the rotor, a feed opening for both drill rod cartridges for feeding the drill rods into the cartridge, and means for displacing the drill rods into the cartridges and out therefrom.

In long-hole drilling the hole is drilled by using extension rods as drill rods, whereby several extension rods or drill pipes of equal length are added one at a time into a sequence to achieve the required hole length. As used in this patent application, the term drill rod refers to solid drill rods or hollow drill pipes. In mechanized drilling, extra or unused drill rods or pipes are stored in various mechanical apparatuses from which a drill rod or pipe is taken and connected to the drill string used in the drilling when required. Such arrangements for storing drill rods or pipes are disclosed e.g. in PCT Application WO84/01599 and USSR Inventor's Certificate 1370225. PCT Application WO84/01599 teaches that drill rods or pipes are placed in two cartridge racks each provided with a rotating rotor. Both rotors are divided into radial storage compartments each containing several drill rods or pipes radially one after another. The publication also discloses a displacing device positioned between the cartridge racks spaced apart from each other. By means of the displacing device one drill rod at a time can be taken out of either cartridge and displaced to the drilling centre. A problem with the arrangement of the publication is that there is provided no kind of support for the drill rods or pipes positioned in the storage compartment close to the discharge opening. A further problem is that the operator has to select and guide the displacing device to the desired cartridge rack both on picking up and on storing rods, and both the picking up of rods and the storing of rods is totally unorganized. Furthermore, in the arrangement of the publication, it cannot be ensured that the rods will not fall out of their hole for some reason, wherefore the arrangement cannot be used in drilling machines in which the drilling direction may vary and in which the whole drilling equipment moves between the drilling operations.

USSR Inventor's Certificate 1370225, in turn, discloses an arrangement in which drill rods or pipes are positioned on a horizontally movable chain formed by chute-like portions and rolled up on both sides of the positioning device. In this arrangement, drill rods or pipes are positioned in superimposed layers and they are supported at the layers whereas they are loose in the space between the chain rolls, and the apparatus can be used only in the horizontal position because otherwise the drill rods or pipes would fall.

It is also known to store drill rods in an individual drill rod cartridge in which drill rods are positioned in one storage compartment at a time similarly as in the above-mentioned PCT application. A problem with this arrangement is the small amount of drill rods or pipes, which cannot be increased to any greater degree on account of the increasing diameter and the resulting clumsiness of the apparatus.

An object of the present invention is to provide an apparatus to be used with a moving drilling equipment and having a greater drill rod or pipe capacity than prior art arrangements. In the apparatus of the present invention, the feeding of drill rods or pipes into the apparatus and out of it takes place in a controlled manner, the drill rods and pipes being all the time supported and guided in such a way that they will not fall regardless of the operating position. According to the invention, this is achieved in such a manner that the two cartridges have a common feed opening positioned substantially midway between the cartridges in such a way that the central line of the feed opening is substantially in the middle of the distance between the axes of the rotors, the drill rods being fed through the common feed opening alternatively into the two cartridges or removed therefrom;

the rotors of the cartridges are interconnected so as to rotate in opposite directions with respect to each other at the same speed;

the cartridges are so mounted with respect to each other that projections in the finger boards of their rotors alternately pass by the line between the axes of the rotors during the rotation of the rotors so that the projection of the finger board of one rotor is always in alignment with the gap of the finger board of the other rotor;

the distance between the rotors is such that when the projection and the opposite gap are substantially in alignment, the projection pushes the drill rod into the gap with the axis of the drill rod located on one side of the central line of the feed opening; and a guide is provided on the opposite side of a plane extending through the axes of the rotors with respect to the feed opening, the guide being positioned substantially on the central line of the feed opening and guides the drill rod in the gap to the side of the corresponding cartridge to the circumference defined by the guiding means.

The basic idea of the invention is that drill rods are stored by means of two cartridges connected operationally in a positively controlled manner, which cartridges comprise means for guiding the drill rods or pipes in such a way that they are constantly supported in position by the guiding means and cannot fall.

The invention will be described in greater detail in the attached drawings, in which FIG. 1 illustrates schematically an apparatus of the invention when installed in a drilling equipment;

Figure 1:
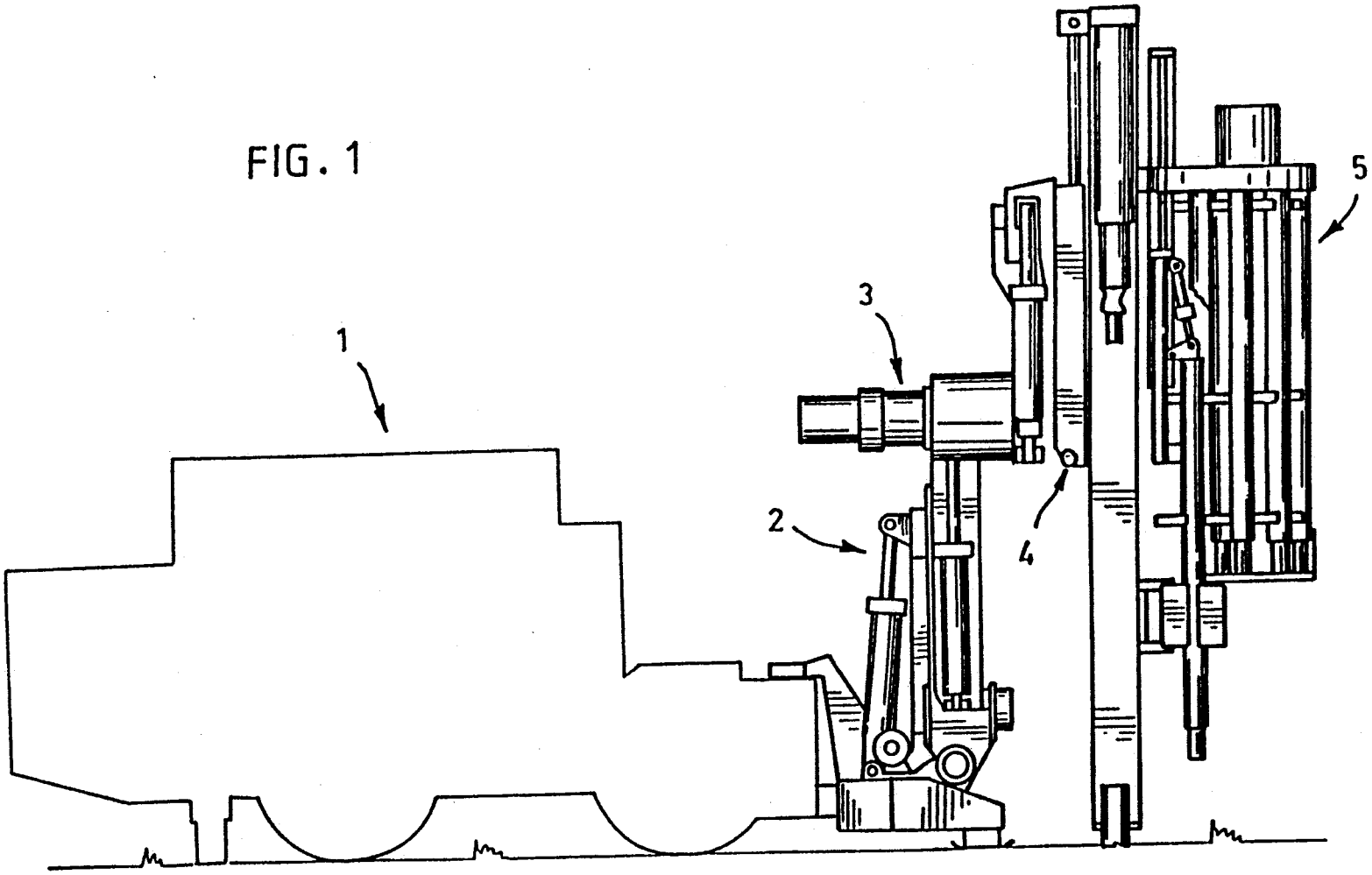
Figure 2:
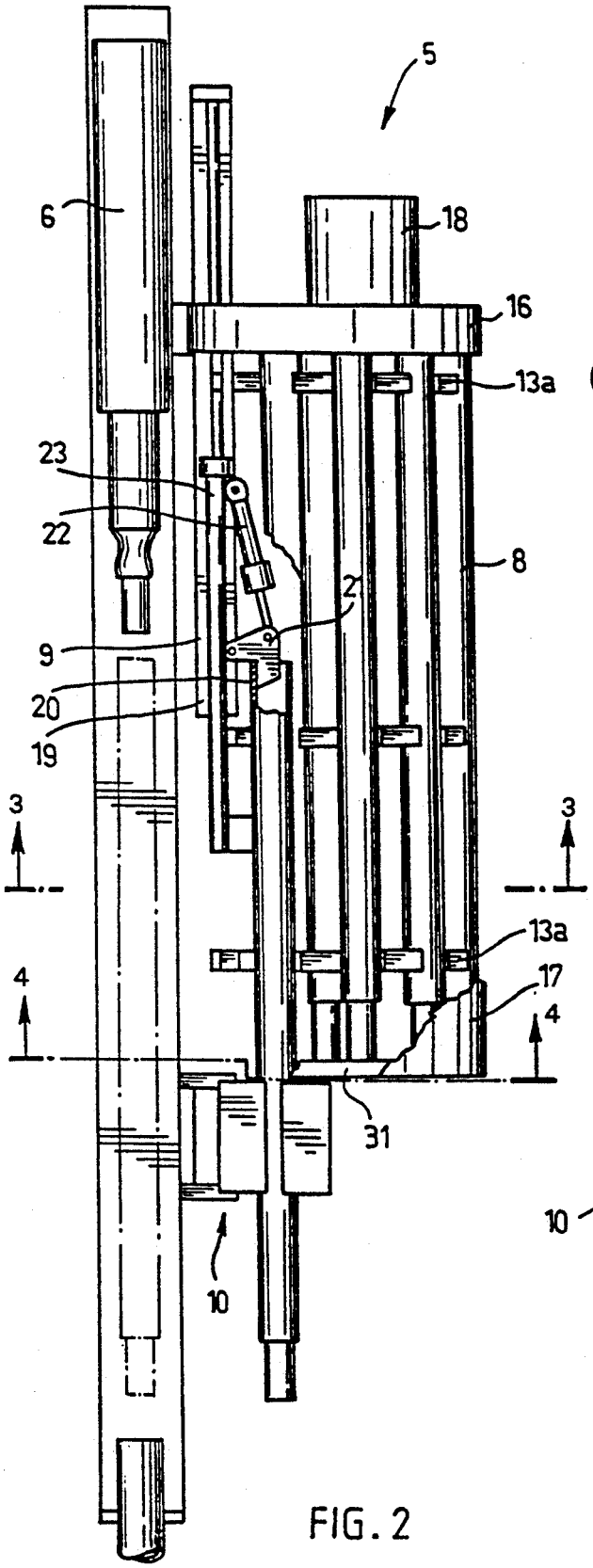
FIG. 2 is a schematic side view of the apparatus of the invention.

FIG. 1 shows a drilling equipment comprising a wheeled carrier 1 and a drill boom 2 attached to the carrier. The drill boom is mounted pivotably by means of joints in the carrier and provided with pivoting means in a manner known per se, wherefore these features will not be described more closely herein. The drill boom 2 further comprises a rotation machinery 3 known per se, to which a cradle 4 is attached. A feeding device 5, on which a drilling machine 6 is movable, is attached to the cradle 4 perpendicularly to the rotation axis. The feeding device can, of course, be mounted in the cradle e.g. obliquely with respect to the rotation axis, if this is advantageous for the operation of the device. Furthermore, two drill rod cartridges 7*a* and 7*b* with drill rods 8 stored therein are attached to the feeding device 5. To displace the drill rods 8 from the cartridges 7 to a drilling position, a first displacing device 9 and a second displacing device 10 are provided. The feeding device 5 comprises a framework 11 known per se, within which feeding cylinders 12 for the drilling machine 6 are provided in a manner known per se. The drilling machine 6 is movable on the feeding cylinders by means of them. As the structure is known per se, it will not be described more closely herein.

Figure 3:
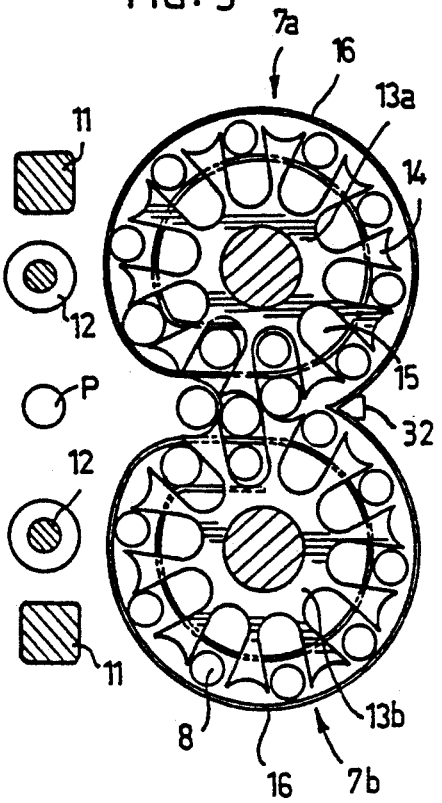
FIG. 3 is a schematic view of the apparatus of the invention at the section 3—3.
Figure 4:
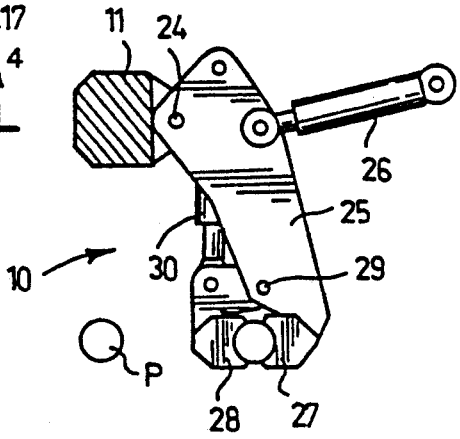
FIG. 4 is a schematic view of the apparatus of the invention at the section 4—4.

Both rod cartridges 7*a* and 7*b* comprise a rotating rotor 13*a* and 13*b* provided with finger boards. As shown in FIG. 3, the rotors comprise triangular projections 14 between which storage gaps 15 are defined. Furthermore, the upper and lower ends of the cartridges are provided with spiral-shaped guides 16 and 17 having a spiral groove along which the drill rods or pipes positioned in the gaps of the finger boards of the cartridges are movable when the rotors 13 rotate. The rotors 13*a* and 13*b* of the cartridges 7*a* and 7*b* are interconnected so as to be movable with respect to each other in such a way that they rotate in opposite directions at the same speed with the gap 15 of the finger board of one rotor in alignment with the triangular projection 14 of the other rotor. The spiral-shaped guides 16, 17 provided at both ends of both cartridges are reversely symmetrical with respect to each other so that each drill rod or pipe will be guided precisely in the same way. A rotation machinery 18 is provided above the cartridges for rotating the rotors of the two cartridges as described above. The apparatus further comprises a feed and discharge opening formed between the spirals of the cartridges 7*a* and 7*b*, through which opening the drill rods or pipes 8 are fed into the cartridges or taken away therefrom for drilling. The displacing device 9 positioned opposite to the feed opening comprises a frame 19 along which an abutment 20 and a press member 21 connected to it are movable. The displacing device 9 is so positioned that the drill rod 8 is pressed against the abutment 20 of the displacing device before it is detached from the finger boards of the rotors 13*a* and 13*b* of the rod cartridges 7*a* and 7*b*. The press member 21 is pressed by a power device 22 against a rod 8 to be removed from the cartridge. As a result, the rod is pressed against the abutment 20 so that it will be supported by the displacing device 9 after it is released from the guidance of the rotors 13*a* and 13*b*. A displacing cylinder 23 is connected to the displacing device 9 for displacing it in the axial direction of the drill pipe and for displacing the drill pipe from the cartridges 7 to the second displacing device 10 or from it to the cartridges 7. The displacing device 10 comprises an arm 25 mounted in the framework 11 pivotably about a joint 24 parallel to the axis of the drill rod. The arm 25 can be pivoted about the joint 24 by a power device 26. Furthermore, a jaw 27 is mounted stationarily to the arm 25, and a second jaw 28 is mounted pivotably about a shaft 29 parallel to the axis of the drill rod so as to be pressed against the first jaw. To pivot the jaw 28, that is to open and close it, a power device 30 is provided between the jaw 28 and the arm 25.

The apparatus operates in the following way. When a new drill rod or pipe 8 is to be added to a drill string in use, the drilling machine 6 is detached from the drill string and displaced to the other end of the feeding device so that a space for the new drill pipe 8 is left between it and the drill string. The rotors 13*a* and 13*b* of the cartridges 7*a* and 7*b* are turned so that they feed the drill pipe 8 next in the gaps of the finger boards of the cartridges against the abutment 20 of the displacing device 9. The drill pipe 8 is locked in this position by turning the press member 21 by means of the cylinder 22 inside the upper end of the pipe, so that it presses the wall of the pipe 8 against the abutment 21. As used in this patent application, the term upper end refers to the end positioned at the top in the figures, that is on the side of the drilling machine. The drill pipe is displaced in its axial direction downwards in FIG. 1 by displacing the displacing device 9 with respect to the frame 19 by means of the displacing cylinder 23 in said direction, whereby the drill pipe to be displaced is inserted between the jaws 27 and 28 of the second displacing device. Thereafter the drill pipe is pressed against the jaw 27 by turning the jaw 28 by means of the power device 30, so that the drill pipe 8 is clamped between the jaws, and the press member 21 of the displacing means 9 can be turned backwards so that the drill pipe 8 is detached from the displacing device. The displacing device 9 is again displaced upwards in the figure, so that the drill pipe 8 has enough space to be passed in a direction transverse to its axis below it, and the drill pipe is turned between the drilling machine 6 and the drill string, whereafter is it fastened to the drill string by rotating the drilling machine 6, and the drilling process is continued. To disengage a drill rod from the drill string, the string is drawn backwards by the drilling machine 6 while the jaws 27 and 28 of the displacing device 10 are positioned on its both sides. After the drill pipe 8 closest to the drilling machine has been displaced to a suitable position, the drill string is gripped by per se known gripping means not shown, and the thread of the uppermost drill pipe with respect to the rest of the drill string and the drilling machine is opened. When the thread opens, the drill pipe 8 is gripped by means of the jaws 27 and 28 of the displacing device so that the drill pipe cannot fall. After both threads have been completely released, the drill pipe 8 is turned from the drilling axis towards the cartridges 7*a* and 7*b* close to the feed and discharge opening. Thereafter the drill pipe 8 is gripped by means of the displacing device 9 by first moving the displacing device 9 downwards and then pressing the upper end of the of drill pipe 8 by means of the press member 21 against the abutment 20. Thereafter the jaws of the second displacing device 10 are detached from the drill pipe 8 and the drill pipe is displaced upwards to the storage cartridges by means of the displacing device 9. On releasing the press member 21 of the displacing device 9, the abutment 21, being flexible, pushes the drill pipe a distance towards the feed opening, whereby the edge of the lower end of the drill pipe 8 is displaced to a bottom plate 31 of the cartridges, whereafter the rotors 13*a* and 13*b* of the cartridges are rotated in such a manner that they displace the drill pipe therebetween and support it between the cartridges. On further rotating the rotors 13*a* and 13*b*, the drill pipe 8 is passed onwards in the space between the cartridges into the gap 15 of the finger board of the rotor of one cartridge, whereby it is supported by the projection 14 of the rotor of the other cartridge. To pass rods alternately into both cartridges, a wedge-shaped guide member 32 is provided at the junction point between the guide spirals 16 on the opposite side with respect to the feed opening on its central line. The guide member 32 forces a drill rod reaching it to the side of the cartridge in the rotor gap of which the drill rod is positioned at this particular moment. From the guide member 32 onwards, the drill rod is maintained in the gap between the threads of the guide spirals 16 and 17 and it does not need to be supported by the other finger board.

The invention has been described above and in the attached drawings by way of example, and it is in no way restricted to it. The structure and operation of the displacing means may vary, provided that their operation corresponds to that described above. The feeding device of the drilling machine may be of any well-known structure, and it may be attached to the storage cartridges and the cartridge assembly and the drilling equipment in various ways, provided that the drilling centre is positioned so that the drill pipe can be displaced from the discharge and feed opening of the cartridges to the drilling centre and back. The apparatus can be used in connection with long-hole drilling equipments of all types, and both drill rods and drill pipes can be stored if the gripping and displacing means are designed according to the requirements of the drilling equipment used in each particular case. The guide passing the drill pipes alternately into the two cartridges must not necessarily be a stationary wedge-shaped member but a guide of some other kind and even a guiding mechanism or a guide member swinging back and forth may be used.

We claim:

1. Apparatus for storing drill rods, comprising two drill rod cartridges, each comprising a rotating rotor provided with finger boards, means for guiding the drill rods into gaps formed by the finger boards circumferentially around the axis of the rotor, a feed opening for both drill rod cartridges for feeding the drill rods into the cartridge, and means for displacing the drill rods into the cartridges and out therefrom, characterized in that:

the two cartridges have a common feed opening positioned substantially midway between the cartridges in such a way that the central line of the feed opening is substantially in the middle of the distance between the axes of the rotors, the drill rods being fed through the common feed opening alternatively into the two cartridges or removed therefrom;

the rotors of the cartridges are interconnected so as to rotate in opposite directions with respect to each other at the same speed;

the cartridges are so mounted with respect to each other that projections in the finger boards of their rotors alternately pass by the line between the axes of the rotors during the rotation of the rotors so that the projection of the finger board of one rotor is always in alignment with the gap of the finger board of the other rotor;

the distance between the rotors is such that when the projection and the opposite gap are substantially in alignment, the projection pushes the drill rod into the gap with the axis of the drill rod located on one side of the central line of the feed opening; and a guide is provided on the opposite side of a plane extending through the axes of the rotors with respect to the feed opening, the guide being positioned substantially on the central line of the feed opening and guides the drill rod in the gap to the side of the corresponding cartridge to the circumference defined by the guiding means.

2. Apparatus according to claim 1 characterized in that the gaps of the finger boards are so deep that at least two drill rods can be fitted into each gap in the radial direction of the rotor, the guiding means of the cartridges being substantially spiral-shaped and mutually substantially reversely symmetrical.

3. Apparatus according to claim 2 characterized in that the displacing means comprise a first displacing device provided with means for gripping the upper end of the drill rod to displace the drill rod by means of the displacing device in its axial direction from the feed opening into a displacing position and correspondingly in the opposite direction.

4. Apparatus according to claim 3 characterized in that the gripping means comprise a press member arranged to be inserted into a flushing hole within the drill rod and an abutment provided in the frame of the gripping means, the press member pressing the wall of the drill rod against the abutment, and the first displacing device being arranged to displace the gripping means substantially in the axial direction of the drill rod.

5. Apparatus according to claim 4 characterized in that the abutment is flexible in the direction of movement of the press member so that when the press member presses the drill rod, the drill rod is displaced over a distance from the feed opening towards the abutment and correspondingly when the press member releases the drill rod, the abutment pushes it towards the feed opening.

6. Apparatus according to claim 3 characterized in that the displacing means comprise a second displacing device for displacing the drill rod in a direction transverse to its axis from the displacing position to the drilling position and correspondingly back.

7. Apparatus according to claim 6, characterized in that the guide is stationarily mounted and wedge-shaped.

* * * * *